US012134855B1

(12) United States Patent
Pelletier

(10) Patent No.: US 12,134,855 B1
(45) Date of Patent: Nov. 5, 2024

(54) FACEMASK CONTAINER FOR USE IN WASHING MACHINES

(71) Applicant: Matthew Pelletier, Pineville, NC (US)

(72) Inventor: Matthew Pelletier, Pineville, NC (US)

( * ) Notice: Subject to any disclaimer, the term of this patent is extended or adjusted under 35 U.S.C. 154(b) by 440 days.

(21) Appl. No.: 17/498,981

(22) Filed: Oct. 12, 2021

(51) Int. Cl.
*D06F 95/00* (2006.01)

(52) U.S. Cl.
CPC ..... *D06F 95/008* (2013.01); *D06F 95/006* (2013.01)

(58) Field of Classification Search
None
See application file for complete search history.

(56) References Cited

U.S. PATENT DOCUMENTS 5,971,236 A 10/1999 DesForges et al.
6,742,683 B1 * 6/2004 Phan ..... D06F 95/008 223/84
7,922,046 B2 4/2011 Lauren

OTHER PUBLICATIONS

DE 10333025 A1 translation, Ball For Washing Ties In Washing Machine Is Made Up Of Threaded Hemispheres Which Screw Together, Tie Being Wound Around Bar With Central Slit Which Fits Inside Ball, Bagdons (Year: 2005).*

* cited by examiner

*Primary Examiner* — Cristi J Tate-Sims
(74) *Attorney, Agent, or Firm* — Sanchelima & Associates, P.A.; Christian Sanchelima; Jesus Sanchelima

(57) ABSTRACT

A facemask container for use in washing machines including a top portion and a bottom portion is disclosed. The facemask container top portion and bottom portion may have a repeating pattern of contour openings, wherein the repeating pattern of contour openings may be oblong in shape to let water in an out of the container. The facemask container top portion and bottom portion may be hingely hooked to each other. The facemask container top portion and bottom portion may be fixed to each other by a fastening mechanism. The facemask container bottom portion may also contain an upright rod used to place straps of the facemasks in order to keep the facemasks within the container and prevent damage because of the washing cycle.

7 Claims, 3 Drawing Sheets

FACEMASK CONTAINER FOR USE IN WASHING MACHINES

BACKGROUND OF THE INVENTION

1. Field of the Invention

The present invention relates to facemask container for use in washing machines and, more particularly, to a facemask container for use in washing machines that is used to contain facemasks within when placed in a washing machine to prevent the facemasks being damaged during a washing cycle.

2. Description of the Related Art

Several designs for clothing storage and cleaning containers for use in washing machines have been designed in the past. None of them, however, include a storage container for facemasks that has a rod to place the facemasks and prevent them to be damage when placed in a washing machine.

Applicant believes that a related reference corresponds to U.S. Pat. No. 5,971,236 issued for a protective bra cage device that is used for protecting a brassier in a washing machine. Applicant believes that another related reference corresponds to U.S. Pat. No. 7,922,046 issued for a brassier storage and cleaning container. None of these references, however, teach of a container use to store facemasks within for use in washing machines to prevent damage to the facemasks due to the washing cycle.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a facemask container to store facemasks within for use in washing machines.

It is another object of this invention to provide facemask container that has an upright rod attached to a bottom portion of the container to place the straps of the facemasks to prevent the facemasks to slip out of the container.

It is still another object of the present invention to provide a facemask container that has a repeating pattern of contour openings to let water in an out of the container.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
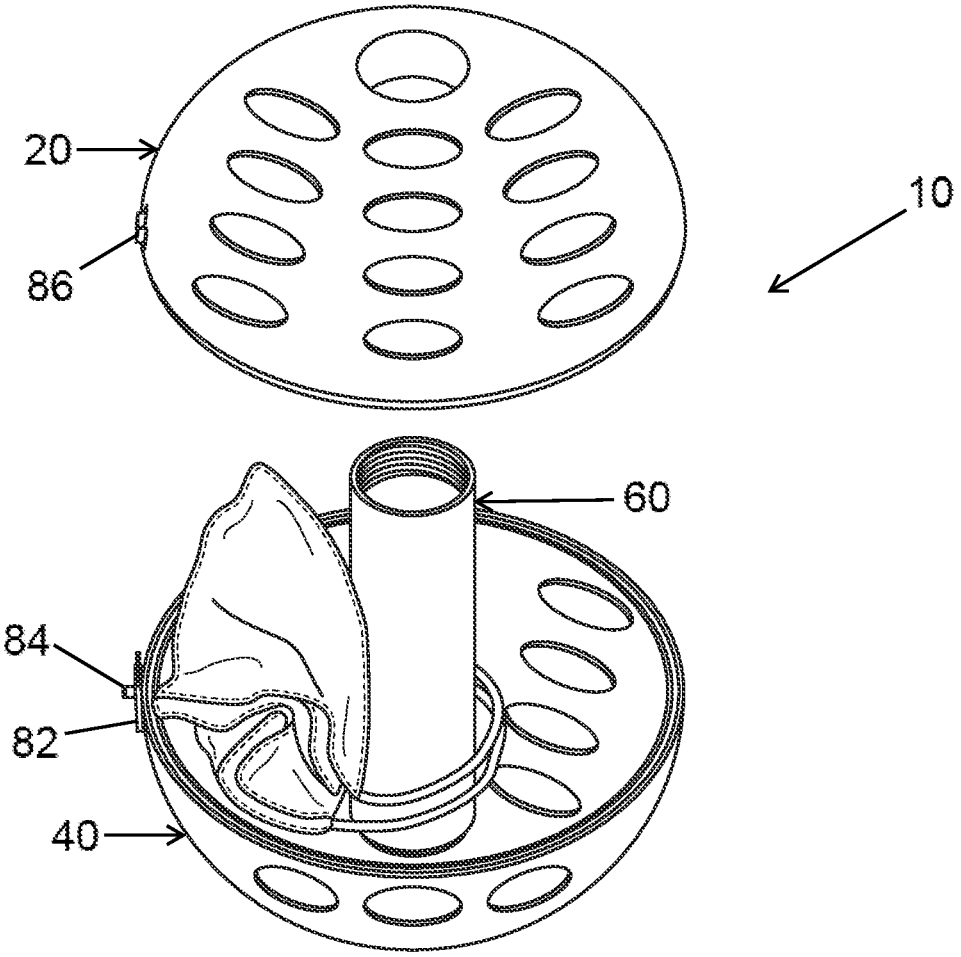
FIG. 1 represents an isometric view of the facemask container for use in washing machines 10 with a facemask strap onto the rod assembly 60.

Referring now to the drawings, where the present invention is generally referred to with numeral 10, it can be observed that it basically includes a top assembly 20, a bottom assembly 40, a rod assembly 60, and a fastening mechanism assembly 80. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Best illustrated in FIGS. 1-4, the facemask container for use in washing machines 10 may have a substantially spherical shape. Nonetheless, it should be understood that the facemask container for use in washing machines 10 may have any shape a user requires. The facemask container for use in washing machines 10 may be made of plastic, polycarbonate, resin, or any other variation thereof. The facemask container for use in washing machines 10 may be made of a rigid material capable of withstanding the movement of a washing cycle without breaking, corrosion and heat resistant. The facemask container for use in washing machines 10 may include the top assembly 20 and the bottom assembly 40, wherein the top assembly 20 and the bottom assembly 40 may be removeably mounted to each other by a tongue and groove configuration. The rod assembly 60 may be mounted perpendicularly to the top assembly 20 and bottom assembly 40. The top assembly 20 and the bottom assembly 40 are fixed together by a fastening mechanism assembly 80. In one embodiment, the fastening mechanism assembly 80 may be a slider latch mechanism. However, it should be understood that the fastening mechanism assembly 80 may be any kind of fastening mechanism available in the known art. The fastening mechanism assembly 80 may be made of plastic, steel, aluminum or any other variation thereof. The fastening mechanism assembly 80 may be made of the same material as the top assembly 20 and the bottom assembly 40.

Figure 2:
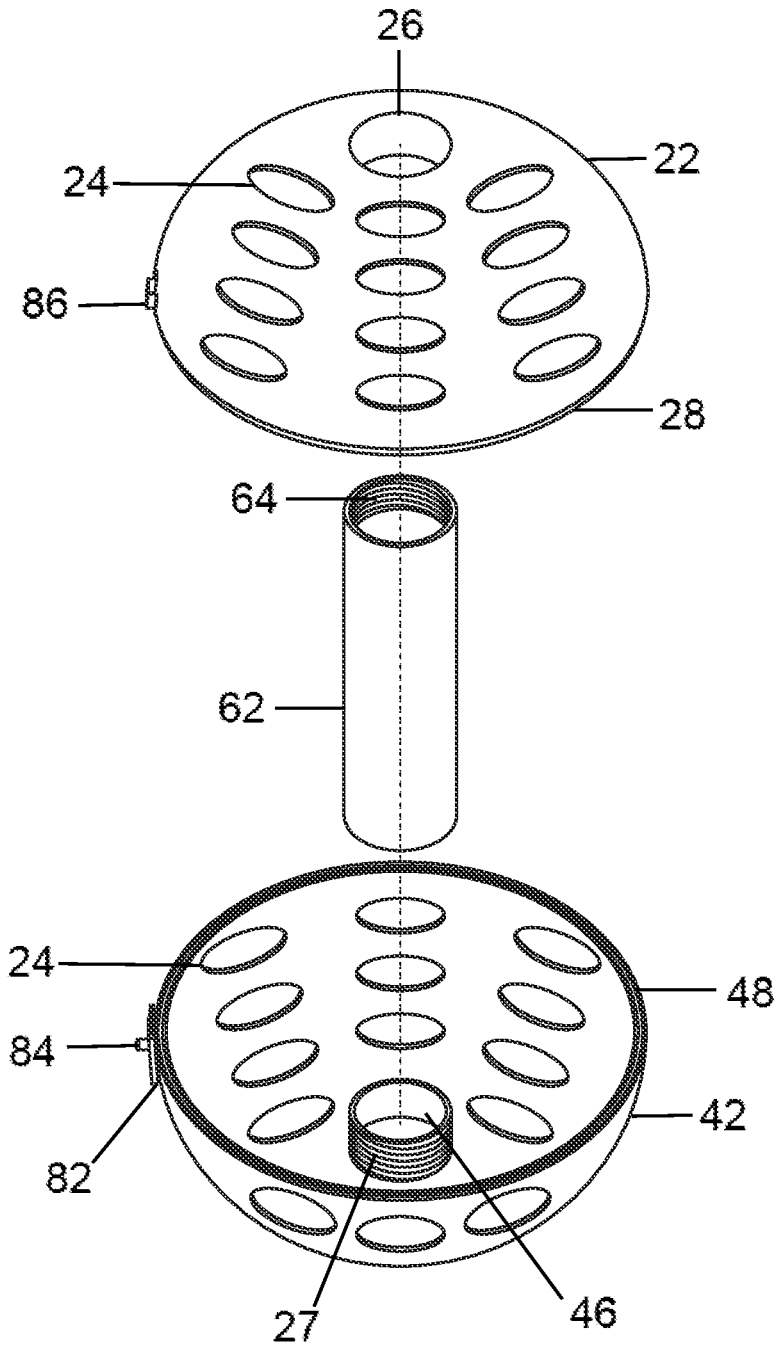
FIG. 2 shows an exploded view showing the top assembly 20, the bottom assembly 42, the rod assembly 60 inline and the fastening mechanism assembly 80.
Figure 3:
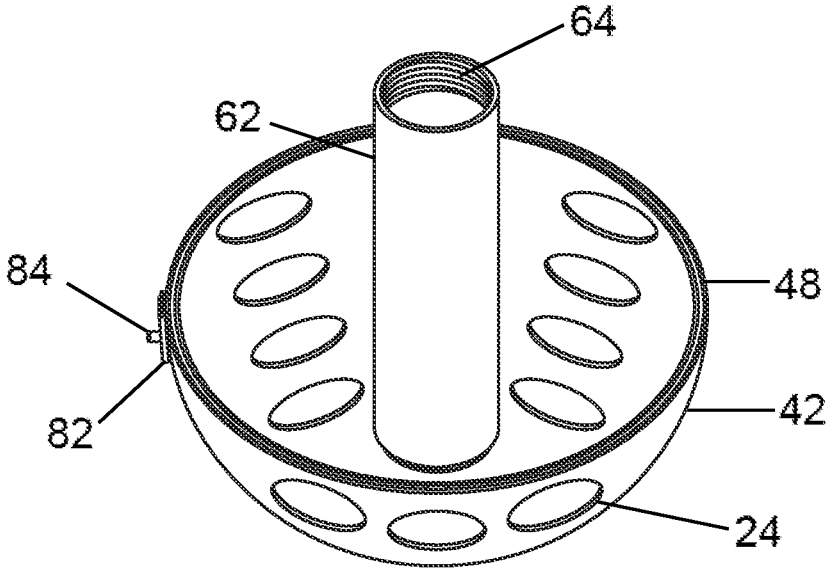
FIG. 3 illustrates a detailed view of the bottom assembly 20 showing the upright rod assembly 60 threaded onto the bottom assembly 20.
Figure 4:
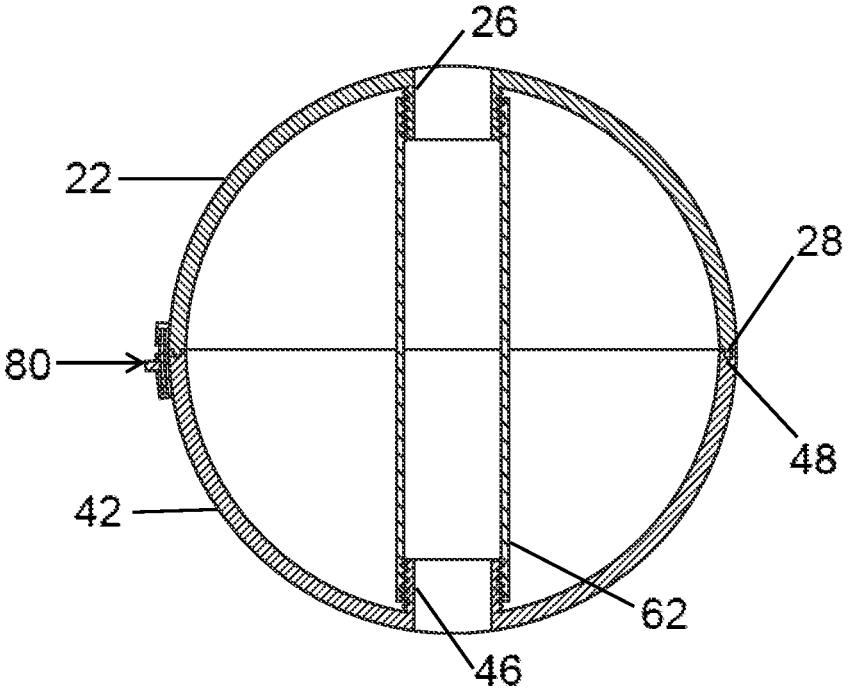
FIG. 4 is a representation of a cross sectional view of the facemask container for use in washing machines 10 showing the connection between the top assembly 20 and the bottom assembly 40, the fastening mechanism assembly 80, the rod assembly 60 threaded onto the top assembly 20 and the bottom assembly 40, and the tongue and groove connection between the top assembly 20 and the bottom assembly 40.

Best illustrated in FIGS. 1, 2 and 4, the top assembly 20 may include a top portion 22, wherein the top portion 22 may have a substantially half-spherical shape. Nonetheless, it should be understood that the facemask container may have any shape a user requires. The top portion 22 may be made of plastic, polycarbonate, resin, or any other variation thereof. The top portion 22 may be made of a rigid material capable of withstanding the movement of a washing cycle without breaking, corrosion and heat resistant. The top portion 22 may also have a repeating pattern of contour openings 24 throughout the top portion 22, to allow water to enter the facemask container for use in washing machines 10, wherein the repeating pattern of contour openings 24 may have an oblong shape. However, it should be understood that the repeating pattern of contour openings 24 may have any shape available. A top inward protrusion 26 may be mounted onto the middle of the top portion 22. The top inward protrusion 26 has a substantially cylindrical shape. The top inward protrusion 26 may have an external thread 27 from an upper end to a lower end of said top inward protrusion 26. The top portion 22 may have a slot 28 all around an edge of said top portion 22 as part of the tongue and groove configuration. A receiving member 86 of the fastening mechanism assembly 80 is attached to an external surface of the top portion 22, right next to the edge of said top portion 22.

Best illustrated in FIGS. 1-4, the bottom assembly 40 may include a bottom portion 42, wherein the bottom portion 42 may have a substantially half-spherical shape. Nonetheless, it should be understood that the facemask container may have any shape a user requires. The bottom portion 42 may be made of plastic, polycarbonate, resin, or any other variation thereof. The bottom portion 42 may be made of a rigid material capable of withstanding the movement of a washing cycle without breaking, corrosion and heat resistant. The bottom portion 42 may also have the repeating pattern of contour openings 24 throughout the bottom portion 42, to allow water to enter the facemask container for use in washing machines 10, wherein the repeating pattern of contour openings 24 may also have an oblong shape. However, it should be understood that the repeating pattern of contour openings 24 may have any shape available. A bottom inward protrusion 46 may be mounted onto the middle of the bottom portion 42. The bottom inward protrusion 46 has a substantially cylindrical shape. The bottom inward protrusion 46 may have an external thread 27 from an upper end to a lower end of said bottom inward protrusion 46. The bottom portion 42 may have a groove 48 all around an edge of said bottom portion 42 as part of the tongue and groove configuration. A holding member 82 of the fastening mechanism assembly 80 is attached to an external surface of the bottom portion 42, right next to the edge of said bottom portion 42, wherein a slider member 84 of the fastening mechanism assembly 80 is operatively mounted to the holding member 82.

Best illustrated in FIGS. 1-4, the rod assembly 60 may include a rod 62, wherein the rod 62 may have a substantially cylindrical shape. The rod 62 may be made of plastic, polycarbonate, resin, or any other variation thereof. The rod 62 may be made of a rigid material capable of withstanding the movement of a washing cycle without breaking, corrosion and heat resistant. The rod 62 may have two opposing distal ends, a first distal end and a second distal end, wherein the first distal end and the second distal end may have an internal thread 64.

In one embodiment, the straps of a facemask or multiple facemasks are mounted to the rod 62, wherein the rod 62 is mounted perpendicular to the top portion 22 and the bottom portion 24. The first distal end of the rod 62 is threaded to the top inward protrusion 26 of the top portion 22. The second distal end of the rod 62 is threaded to the bottom inward protrusion 46 of the bottom portion 42. The top portion 22 is removeably mounted to the bottom portion 42 by the tongue and groove configuration. The slider member 84 is actuated towards the holding member 86 to fix the top portion 22 to the bottom portion 24, wherein the facemask container for use in washing machines 10 is placed into a washing machine to let the facemasks be washed, thus preventing damaging and breakage of the facemasks.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A facemask container for use in washing machines, comprising:

a. a top assembly having a top portion with a repeating pattern of contour openings, wherein the repeating pattern of contour openings are oblong in shape, wherein said top inward protrusion has an external thread from an upper end to a bottom end of said top inward protrusion, said top inward protrusion has an external thread from an upper end to a bottom end of said top inward protrusion;

b. a bottom assembly having a bottom portion with said repeating pattern of contour openings, said bottom portion has a bottom inward protrusion, said bottom inward protrusion has said external thread from an upper end to a bottom end of said bottom inward protrusion;

c. a rod assembly having a rod to mount straps of facemasks, wherein said rod is mounted perpendicular to said top portion and the bottom portion, said rod has an internal thread on a first distal end and a second distal end of said rod, the internal thread of the rod cooperates with the bottom inward protrusion and the top inward protrusion to removably secure the rod to the top assembly and bottom assembly and;

d. a fastening mechanism assembly including a holding member a slider member and a receiving member, said holding member is attached to an exterior surface of said top portion, right next to said edge of said top portion, said slider member protrudes perpendicularly from said holding member said receiving member is attached to an exterior surface of said bottom portion, right next to said edge of said bottom portion, said fastening mechanism assembly removably secures the bottom assembly to the top assembly.

2. The facemask container for use in washing machines of claim 1, wherein said top portion and said bottom portion have a substantially half-spherical shape.

3. The facemask container for use in washing machines of claim 1, wherein said top portion has a slot all around an edge of said top portion.

4. The facemask container for use in washing machines of claim 1, wherein said bottom portion has a groove all around an edge of said bottom portion.

5. The facemask container for use in washing machines of claim 1, wherein said receiving member is mounted to an exterior surface of said bottom portion, right next to an edge of said bottom portion.

6. A facemask container for use in washing machines, comprising:

a. a top assembly having a top portion with a repeating pattern of contour openings, wherein the repeating pattern of contour openings have an oblong shape, the top portion has a substantially half-spherical shape, said top portion includes a top inward protrusion having an external thread from an upper end to a bottom end of said top inward protrusion, the top portion further includes a slot all around an edge of said top portion;

b. a bottom assembly having a bottom portion with said repeating pattern of contour openings, the bottom portion has a substantially half-spherical shape, said bottom portion includes a bottom inward protrusion having said external thread from an upper end to a bottom end of said bottom inward protrusion, the bottom portion further includes a groove all around an edge of said bottom portion;

c. a rod assembly having a rod to mount straps of facemasks, wherein said rod is mounted perpendicular to said top portion and bottom portion, said rod includes an internal thread on a first distal end and a second distal end of said rod;

d. a fastening mechanism assembly being a slider latch mechanism having a holding member, a slider member and a receiving member, said holding member is attached to an exterior surface of said top portion, right next to said edge of said top portion, said slider member protrudes perpendicularly from said holding member, said receiving member is attached to an exterior surface of said bottom portion, right next to said edge of said bottom portion;

e. said first distal end of the rod is threaded to said bottom inward protrusion of the bottom portion, the second distal end of said rod is threaded to the top inward protrusion of said top portion;

f. said top portion is removably mounted to said bottom portion through said slot and said groove respectively in a tongue and groove configuration; and g. said top portion is fixed to said bottom portion via said slider latch mechanism by actuating said slider member towards said receiving member.

7. A facemask container for use in washing machines, consisting of:

a. a top assembly having a top portion with a repeating pattern of contour openings throughout said top portion, to allow water to enter the facemask container for use in washing machines, wherein the repeating pattern of contour openings have an oblong shape, the top portion has a substantially half-spherical shape and is made of a plastic material that is corrosion and heat resistant, said top portion includes a top inward protrusion mounted onto a middle of the top portion, having a substantially cylindrical shape, and an external thread from an upper end to a bottom end of said top inward protrusion, the top portion further includes a slot all around an edge of said top portion;

b. a bottom assembly having a bottom portion with said repeating pattern of contour openings throughout said bottom portion, to allow water to enter the facemask container for use in washing machines, the bottom portion has a substantially half-spherical shape and is made of a plastic material that is corrosion and heat resistant, said bottom portion includes a bottom inward protrusion mounted onto a middle of the top portion, having a substantially cylindrical shape, and said external thread from an upper end to a bottom end of said bottom inward protrusion, the bottom portion further includes a groove all around an edge of said bottom portion;

c. a rod assembly having a rod to mount straps of facemasks, the rod has a substantially cylindrical shape and is made of a plastic material that is corrosion and heat resistant, said rod is mounted perpendicular to said top portion and bottom portion, said rod includes an internal thread on a first distal end and a second distal end of said rod;

d. a fastening mechanism assembly being a slider latch mechanism having a holding member, a slider member and a receiving member, said holding member is attached to an exterior surface of said top portion, right next to said edge of said top portion, said slider member protrudes perpendicularly to said holding member, said receiving member is attached to an exterior surface of said bottom portion, right next to said edge of said bottom portion;

e. said first distal end of the rod is threaded to said bottom inward protrusion of the bottom portion, said straps of facemasks are mounted to said rod threaded to said bottom portion, the second distal end of said rod is threaded to the top inward protrusion of said top portion;

f. said top portion is removably mounted to said bottom portion through said slot and said groove respectively in a tongue and groove configuration; and g. said top portion is fixed to said bottom portion via said slider latch mechanism by actuating said slider member towards said receiving member.

* * * * *